United States Patent [19]

Bradford

[11] 4,284,278

[45] Aug. 18, 1981

[54] FLYING TOY

[76] Inventor: Joseph Bradford, 11145 Cyprus Glenn Ave., Baton Rouge, La. 70807

[21] Appl. No.: 131,319

[22] Filed: Mar. 18, 1980

[51] Int. Cl.[3] ..... A63B 65/08

[52] U.S. Cl. ..... 273/426; 244/198; 416/227 A; 416/231 R

[58] Field of Search ..... 273/426; 244/99, 198, 244/199; 416/231 R, 227 A

[56] References Cited

U.S. PATENT DOCUMENTS

| | | | |
|---|---|---|---|
| 1,888,056 | 11/1932 | Verzillo et al. | 416/231 X |
| 3,565,434 | 2/1971 | Liston | 273/426 |
| 3,596,854 | 8/1971 | Haney, Jr. | 244/199 |
| 3,881,729 | 5/1975 | Block | 273/426 |
| 4,216,962 | 8/1980 | Flemming | 273/426 |

FOREIGN PATENT DOCUMENTS

| | | | |
|---|---|---|---|
| 919701 | 12/1946 | France | 273/426 |
| 439049 | 9/1948 | Italy | 416/227 A |

OTHER PUBLICATIONS

Playthings Magazine, 4–1959, p. 115, Cloud Climber.

*Primary Examiner*—Paul E. Shapiro

*Attorney, Agent, or Firm*—Edwin E. Greigg; Felix J. D'Ambrosio; Thomas E. McDonald

[57] ABSTRACT

A flying toy of the boomerang type having at least three airfoils, or wings, equiangularly spaced about a central vertical axis and extending horizontally outward from a center portion. Each wing carries at its outer end an annular-shaped wing stabilizer having a circular, horizontally-disposed, outer edge whose diameter is approximately twice the horizontal width of the wing at the juncture of the wing and the wing stabilizer, and having a circular inner edge which is disposed in the same horizontal plane as the outer edge, and which defines a center opening through the stabilizer. The stabilizer has a convex top annular surface and a concave bottom annular surface extending between the inner and outer peripheries. During flight, the stabilizers serve simultaneously as airfoils, wing stabilizers, and a gyroscope for the flying toy. The toy also includes a tubular central stabilizer, concentrically spaced about the central vertical axis and extending upward from the center portion, which carries at least three equiangularly spaced, vertically disposed blades extending radially therefrom.

5 Claims, 5 Drawing Figures

FIG.1
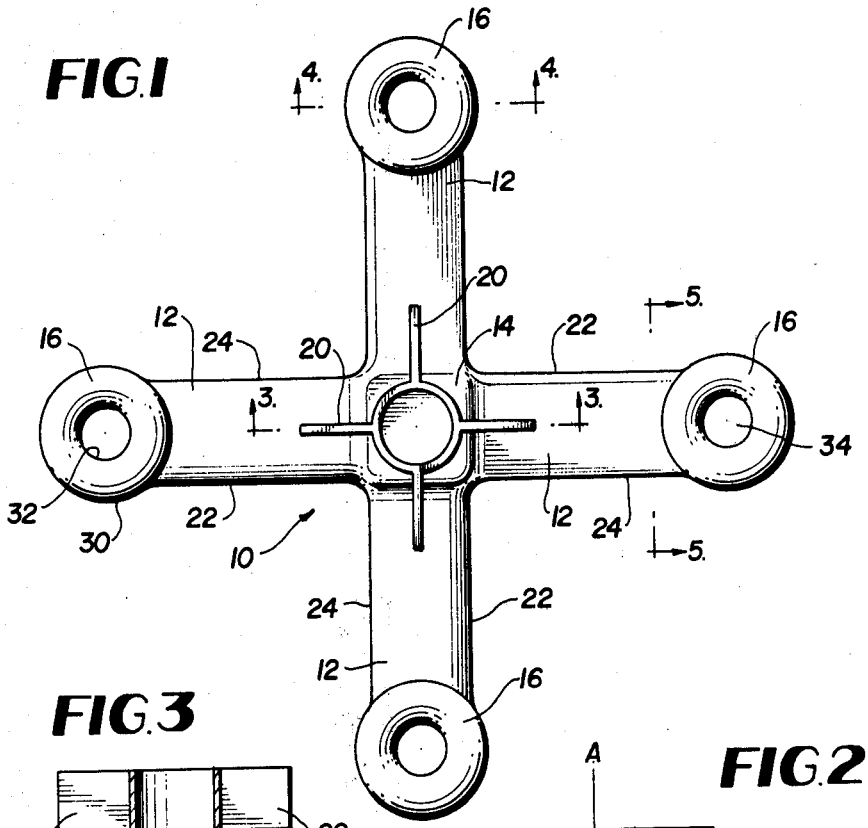
FIG.3
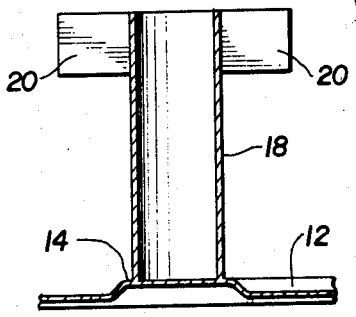
FIG.2
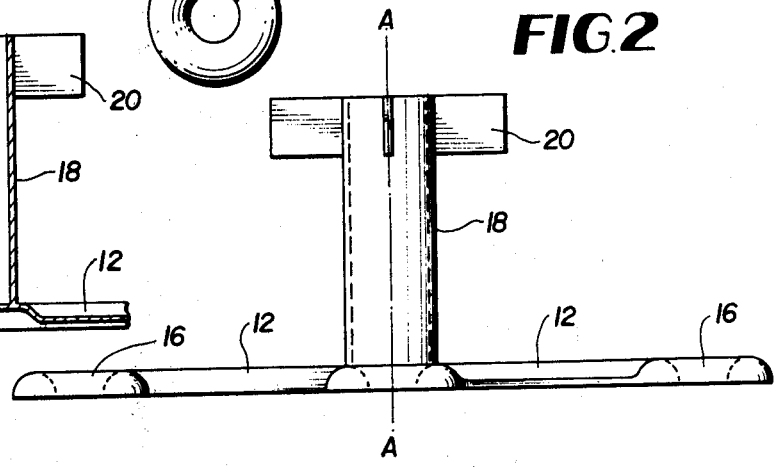
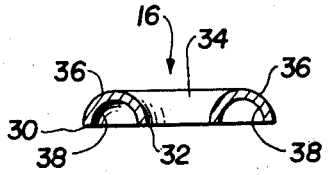
FIG.4
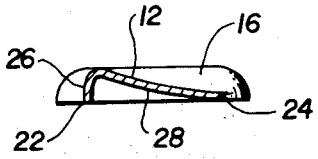
FIG.5

FLYING TOY

BACKGROUND OF THE INVENTION

1. Field of the Invention

The invention relates generally to flying toys of the boomerang type, and in particular, to boomerangs having equiangularly spaced wing or airfoil portions extending radially from a central junction and disposed substantially in a common plane.

2. Prior Art

U.S. Pat. No. 3,955,817, issued May 11, 1976 to James E. Davis, describes a boomerang constructed of three or more airfoils, equiangularly disposed about a common axis, and extending radially outward to a circular rim member which provides increased angular momentum and enhances the gyroscopic stability of the boomerang once it is launched. The boomerang also includes an axially extending stabilizer rod.

U.S. Pat. No. 3,881,729, issued May 6, 1975 to Block et al, discloses a flying toy of the boomerang type having either three or four equiangularly spaced arms extending radially from a common junction. The arms have alternate or consecutive tips turned upward and downward, and the central junction is provided with an air permeable aerodynamic resistance element in the form of a cylindrical tube to provide a smooth non-fluttering flight, and to sharply decrease the linear speed of the flying toy towards the end of its flight.

SUMMARY OF THE INVENTION

The flying toy described herein is a boomerang type device having a plurality of airfoils, or wings, equiangularly spaced about a central axis and extending radially outward from this central axis in a common plane. The device includes a central stabilizer in the form of a tubular center member extending upward from the plane of the wings along the center axis, which carries a plurality of axially extending blades about its periphery to increase aerodynamic resistance. Also, the outer end of each wing carries another stabilizer, which is similar in shape to one-half of a doughnut cut along a plane orthogonal to the axis of the hole extending therethrough. The flat side of each wing stabilizer is disposed in the common plane of the wings so that the wing stabilizers also act as air foil elements. However, because of the center openings in the wing stabilizers, air will flow upward through these center openings during flight of the device to reduce the lift at this point and thus stabilize the wings. Also, during flight, the wing stabilizers provide additional angular momentum and enhance the gyroscopic stability of the device.

BRIEF DESCRIPTION OF THE DRAWINGS

FIG. 1 is a top view of one embodiment of the invention;

FIG. 2 is a side view of the embodiment of FIG. 1;

FIG. 3 is a cross-sectional view of a central portion of the embodiment of FIG. 1; as viewed along the lines 3—3 of FIG. 1;

FIG. 4 is a cross-sectional view of a wing stabilizer of the embodiment of FIG. 1, taken along the lines 4—4 of FIG. 1; and FIG. 5 is a cross-sectional view of one of the wings of the device shown in FIG. 1, taken along lines 5—5 of FIG. 1, which also shows a side view of the wing stabilizer.

DESCRIPTION OF THE PREFERRED EMBODIMENT

Referring now to FIGS. 1 and 2, the flying toy 10 which may be formed of a durable and light weight plastic material, includes four wings 12, which are disposed equiangularly about a vertical center axis A—A of the flying toy 10 and extend radially outwardly from a center portion 14 in a common horizontal plane to respective wing stabilizers 16.

A tubular central stabilizer 18, which is concentrically disposed about the center axis A—A, has a lower end affixed or integral with the center portion 14, and an upper end which carries four equi-angularly spaced blades 20, which extend radially outward from the outer periphery of the tubular central stabilizer 18. Each of the blades 20 is disposed in a vertical plane orthogonal to the plane of the wings 12, and thus do not provide lift for the flying toy 10 during flight, but merely act as aerodynamic resistance elements to stabilize the device 10 during flight.

Each wing 12 has a generally convex upper surface and a generally concave lower surface between its leading edge 22 and its trailing edge 24. A front portion of each wing 12 extending upward and rearward from the leading edge 22 of each wing 12 has a convex upper surface 26, to cause the air flowing along the top side of each wing 12 to have a longer path than the air flowing along the bottom side of each wing 12, thus producing a differential pressure in an upward direction on each wing 12. A back portion of each wing 12, extending downward and backward from the top part of the front portion to the trailing edge 24 of each wing 10, has a convex lower surface 28, against which the air flowing adjacent the bottom side of each wing 12 exerts a positive upward pressure.

Each wing stabilizer 16 has a circular outer edge or periphery 30 disposed in the same horizontal plane as the leading and trailing edges 22, 24 of the adjoining wing 12, which has a horizontal width between its leading and trailing edges 22, 24 of approximately half the diameter of the wing stabilizer periphery 30 at the juncture of the wing 12 and the wing stabilizer 16. Also, each wing stabilizer 16 has a circular inner edge 32 disposed concentrically with and in the same horizontal plane as the outer edge 30. The inner edge 32 defines a center opening 34 having a diameter of approximately one-third the diameter of the outer edge 30. A top surface 36 of the wing stabilizer 16, extending between the inner and outer edges 30, 32, has the shape of the upper half of a torus symetrically disposed about the center of the circular center opening 34, that is, in a vertical cross sectional view of the wing stabilizer 16, the top surface 36 has a semicircular shape on each side of the center opening 34. A bottom surface 38 of the stabilizer 16, extending between the inner and outer edges 30, 32, is shown in FIG. 2 as a concave surface. However, if desired, the bottom surface 38 may be a flat surface, or even a convex surface, which deviates less than the top surface 36 from the horizontal plane of the outer edge 30 in a vertical direction, whereby the path of air flowing across the upper surface 36 during flight of the device 10 is longer than the path of air flowing across the bottom surface, to thus produce a lower pressure on the upper side of the wing stabilizer 16 than on the lower side of the wing stabilizer 16. This difference in pressure simultaneously provides additional lift to the device 10 and forces air to flow upward through the center opening 34 to reduce lift at this point and thus stabilize the wing 12. Also, the mass of the wing stabilizer is greater than the mass of an adjacent portion of wing 12 having the same radial dimension as the wing stabilizer 16, so that the wing stabilizers provide additional angular momentum and enhance the gyroscopic stability of the device 10.

While the illustrated embodiment of the invention has four wings 12, it is only essential to the invention that the device 10 have at least three horizontal wings 12, each carrying a wing stabilizer 16, which are equiangularly spaced about and extend radially from a central vertical axis of the device. Also, while the illustrated embodiment of the invention has four blades 20, it is only essential to the invention that the device 10 have at least three equiangularly blades 20. Also, it is not necessary that the number of blades 20 be equal to the number of wings 12.

In principle, stabilizers similar in shape to the stabilizers 16 described herein and disposed on the ends of the wings of fixed wing aircraft, should stabilize these wings and reduce vibration of the aircraft during flight. In addition, since these stabilizers would be disposed at a maximum distance from the passenger-carrying compartment of the aircraft, fuel storage tanks disposed within these stabilizers would appear to be much safer than the wing fuel storage tanks presently used in fixed wing aircraft. Also, stabilizers similar to the stabilizers 16 herein and disposed at the ends of helicopter rotor blades should stabilize these blades and reduce vibration during flight of the helicopter.

Since these and other changes or modifications can be made to the single illustrated embodiment of the invention described herein, it is intended that the scope of the invention be limited only by the appended claims.

What is claimed and desired to be secured by Letters Patent of the United States is:

1. In a flying device of the boomerang type having a central vertical axis, a center portion symetrically disposed about the central axis, and at least three substantially identical wing portions equiangularly spaced about the central axis and extending radially outward from the center portion in a horizontal plane, the improvement wherein each wing portion carries at its outer end an annular-shaped stabilizer having:

concentrically arranged, horizontally disposed, inner and outer edges, an annular bottom surface extending between the inner and outer edges; and a convex annular top surface extending between the inner and outer edges;

wherein the inner edge defines a center opening extending through the stabilizer between the top and bottom surfaces, and the bottom surface of the stabilizer deviates less than the topsurface from the horizontal plane of outer edge in a vertical direction, whereby, during flight of the device, the stabilizer acts as an airfoil to provide additional lift, and air flowing upward through the center opening acts to stabilize the adjoining wing portion.

2. A device, as described in claim 1, wherein the bottom surface of the stabilizer is a concave surface.

3. A device, as described in claim 1, wherein the top surface of the stabilizer has the shape of an upper half of a torus symetrically disposed about a vertical axis.

4. A flying device, as described in claim 1, which further comprises a tubular central stabilizer, concentrically disposed about the central axis, having one end affixed to the center portion and an opposite end, the outer periphery of the tubular central stabilizer adjacent its opposite end carrying a plurality of flat blades equiangularly spaced about the center axis, each blade extending radially outward and longitudinally parallel to the central axis in a vertical plane orthogonal to the plane of the wing portions.

5. A flying device, as described in claim 1, wherein each wing portion includes front and rear edges, a front portion which extends upward and backward from the front edge and a back portion which extends downward and backward from the front portion to the back edge, the front portion having a convex upper surface, and the back portion having a convex lower surface.

* * * * *